US005532980A

United States Patent [19]

Zarate et al.

[11] Patent Number: 5,532,980

[45] Date of Patent: Jul. 2, 1996

[54] VIBRATIONAL ANTI-FOULING SYSTEM

[75] Inventors: Carlos E. Zarate; H. Graciela Zarate; Clarence Verge, all of Hamilton, Canada

[73] Assignee: Sciencetech Inc., London, Canada

[21] Appl. No.: 339,693

[22] Filed: Nov. 14, 1994

[51] Int. Cl.[6] ..... H04B 1/02

[52] U.S. Cl. ..... 367/139; 367/175; 181/140

[58] Field of Search ..... 367/175, 139, 367/131; 181/140

[56] References Cited

U.S. PATENT DOCUMENTS

| | | | |
|---|---|---|---|
| 2,366,162 | 1/1945 | Vang | 367/141 |
| 2,496,060 | 1/1950 | Mell et al. | 367/174 |
| 3,430,007 | 2/1969 | Thielen | 367/175 |
| 3,480,906 | 11/1969 | Thompson | 367/152 |
| 3,524,027 | 8/1970 | Thurston et al. | 367/174 |
| 4,004,266 | 1/1977 | Cook et al. | 367/165 |
| 4,092,858 | 6/1978 | Edgerton | 73/170 A |
| 4,339,746 | 7/1982 | Ulicki et al. | 340/518 |
| 4,485,450 | 11/1984 | Characklis et al. | 364/550 |
| 4,868,799 | 9/1989 | Massa | 367/172 |
| 4,875,199 | 10/1989 | Hutchins | 367/175 |
| 5,199,005 | 3/1993 | Forsberg | 367/115 |
| 5,426,388 | 6/1995 | Flora et al. | 327/110 |

FOREIGN PATENT DOCUMENTS

| | | |
|---|---|---|
| 703158 | 1/1954 | United Kingdom . |
| 719650 | 12/1954 | United Kingdom . |

OTHER PUBLICATIONS

Abandoned U.S. patent application Ser. No. 07/795,494 filed Nov. 21, 1991 entitled "Transducer for Vibrating Near Surface Underwater Structures" comprising of 15 pages of specification; 2 pages of drawings.

*Primary Examiner*—J. Woodrow Eldred

*Attorney, Agent, or Firm*—Sixbey, Friedman, Leedom & Ferguson

[57] ABSTRACT

An anti-fouling system for producing vibrations in an underwater structure to inhibit the attachment of aquatic life forms to the structure. The system includes a controller which drives one or more transducer. The transducer comprises a housing, one end of which is closed by a resilient diaphragm. An electromagnet with soft magnetic core is contained in the housing spaced from an unsupported portion of the diaphragm. The unsupported portion of the diaphragm is mounted over an underwater structure. In operation, the electromagnet is excited with a current pulse, which deforms the diaphragm so that the housing moves towards the structure. As the current drops off, the diaphragm is restored to its original shape and the housing moves away from the structure imparting a vibrational force to the structure. The transducer includes an elastic membrane to compensate for changes in temperature and pressure commonly found when working under water. The magnetic cores positioned in the transducers are saturated by current pulses generated by the controller to eliminate the effects of component variations and allow multiple units to be connected to the controller without changes in sound levels. The system is highly resistant to electrolytic corrosion, since, most of the time, there is no voltage difference between the resonators, wires, and ground.

14 Claims, 6 Drawing Sheets

VIBRATIONAL ANTI-FOULING SYSTEM

TECHNICAL FIELD OF THE INVENTION

This invention relates to a system consisting of one or more electromagnetic transducers with a vibrating membrane and a controller for use in inhibiting the attachment of aquatic life forms to near surface underwater structures, such as boat hulls.

BACKGROUND OF THE INVENTION

Fouling or biofouling organisms attach to underwater structures on which they grow and develop. Growth of these organisms on surfaces associated with power plant cooling water systems can interfere with the efficient operation of the plant when the organisms block the flow of cooling water. The most common anti-fouling treatment used by power plants is water chlorination. However, this approach has adverse environmental effects on aquatic life, and recent publications have raised concerns about its long term human health effects.

Barnacles attach in large quantities to floating structures. When attached to the hull of a boat or ship, for example, barnacles increase drag and impair maneuverability. On buoys, their added weight lowers the floatation line, sometimes to the point of sinking the buoy. One method used to avoid barnacles is to paint the structure with an anti-fouling paint. However, these paints leak toxic chemicals into the water which are hazardous to life in the waterways. Furthermore, the efficacy of the paint decreases quickly with time so that the floating structures have to be hauled out for periodic scraping and painting with considerable cost and down-time.

Vibrations of certain frequencies can repel aquatic life forms and there is a need for a suitable anti-fouling system for small vessels applying this theory. One method is disclosed in U.S. Pat. No. 2,366,162 to Vang et al. which is directed to reducing the skin friction of water by vibration.

Great Britain Patent Nos. 703,158 and 719,650 refer to a method for minimizing marine growths on ship hulls by generating ultrasonic frequencies through piezoelectric transducers. The system requires a prime mover such as a steam turbine which moves an alternator to generate electrical power for the system. An oscillator is used to supply the ultrasonic frequencies.

An anti-fouling system based on an electromagnetic transducer was the subject of a patent application to Zarate and Verge, U.S. Ser. No. 07/795,494, filed on Nov. 21, 1991, which was later abandoned on Jun. 3, 1992. The anti-fouling system disclosed in the above U.S. application comprises an electronic system for preventing biofouling of boats and other water structures by producing sonic and ultra sonic vibrations. The system further included a microprocessor based controller with very low duty cycle for low current consumption, four ports for resonator connections, and an electromagnetic membrane transducer or resonator with a small gap and a ferrite core to provide a large vibrational force with low energy consumption.

The Zarate and Verge system has a current limit set by the controller electronics. Variations of the sound level from port to port are observed due to variability of the value of the electronic components of the controller circuit that limits the maximum current to each resonator. Moreover, the acoustic power level from each resonator decreases significantly when additional resonators are connected to the same port of the controller unit. A decrease in the sound level reduces the effectiveness of the device and will eventually eliminate anti-fouling action. A desirable system operates in such a way that additional resonators can be connected to the same port without changes in the sound level produced by each individual resonator. This allows the system to be used without component adjustments nor modifications, for small or large structures, just by changing the number of resonators connected to each port. Furthermore, there should the smallest possible variations in the sound level from port to port.

In an effort to achieve these goals, the original design was modified to increase the ohmic resistance of the resonators. Consequently, the current through each resonator is limited by the battery voltage and the resonator resistance in such a way that the controller current compliance is only reached in the case of a short circuit. A problem with this approach is that there is a significant decrease in the sonic output of the resonator for the same current due to the ohmic losses. Decreasing the gap to increase the magnetic field to compensate for this loss produces manufacturing tolerance problems and increases the sensitivity of the resonator to pressure and temperature changes.

One way to solve the problem of variations with multiple transducers would be to use permanent magnet type transducers. Transducers of the permanent magnet type have been used for a long time, for example, as sound speakers. This type of transducer would not be adequate for the desired application, however, due to large cost and size required for the same effect as electromagnetic transducers. Further, the vibrational force of an electromagnet can be larger than that of a permanent magnetic transducer for an equivalent magnetic field. The maximum magnetic field is the saturation flux density of the magnetic material from which the pole pieces are constructed. In contrast, with a permanent magnet transducer, the magnetic field is equivalent to the permanence of the permanent magnet. Since the saturation flux is approximately twice the permanence, a larger vibrational force is realized with the electromagnetic transducer of this invention. Therefore, it is desired to provide a solution using electromagnetic transducers. A novel solution to this problem is proposed.

The resonators of Zarate and Verge can operate only under near surface conditions. They are water resistant but not waterproof at one or two meters of depth as is required for devices installed in large ships that include ballast water. The main problem with working at water depths of more than one meter is the collapse of the resonator diaphragm. A similar problem arises with internal pressure changes produced by large temperature variations. As a result of the internal and external pressure changes, the resonator diaphragm is deflected. This occurrence changes the magnet gap and can collapse the diaphragm if the external pressure is large enough. If, instead, the internal pressure increases, the gap increases and the sound level is reduced.

In ships carrying ballast water, the resonators would be mounted in the inside of the ship under 90 cm of water. This produces a ten percent increase of the external pressure above the atmospheric value. The resonators are also subject to temperature variations that change the inside air volume proportionally. In air, changes as large as twenty percent over the design temperature of 300° K. can be expected. For units under water, the temperature changes are smaller than 10 percent. A novel method to avoid these limitations is proposed.

In the Zarate and Verge system, wires and connectors are subject to electrolytic corrosion even with silicone coated heat-shrink tubing. This problem is exacerbated in underwater operation. We propose a method to minimize this problem.

This invention seeks to overcome drawbacks of known anti-fouling systems and to provide a transducer suitable for underwater vibrational anti-fouling. This invention further seeks to provide an efficient system and method for producing a large anti-fouling effect using minimal power and low current consumption.

SUMMARY OF THE INVENTION

Therefore, it is a general object of the present invention to provide a system for effectively inhibiting the attachment of aquatic life forms to near surface underwater structures.

It is another object of the present invention provide an anti-fouling system that does not have an adverse environmental effect on aquatic life.

It is also another object of the present invention to provide an anti-fouling system that does not compromise the safety of humans.

It is further another object of the present invention to provide an anti-fouling system capable of creating uniform vibrational sound levels at each output port of a control device to effectively prevent the attachment of biofouling organisms on underwater surfaces.

It is yet another object of the present invention to provide an anti-fouling system where additional resonators may be connected to the same output port of a control device without changes in sound levels produced by each individual resonator.

It is another object of the present invention to provide an anti-fouling system that produces a strong, uniform magnetic force in each transducer connected to a single controller.

It is also another object of the present invention to provide an anti-fouling system that includes a transducer capable of compensating for external water pressure and internal air pressure.

It is further an object of the present invention to provide an anti-fouling system that includes a transducer capable of compensating for temperature variations in the surrounding environment.

It is yet another object of the present invention to provide an anti-fouling system that includes a power switching circuit designed to reduce electrolytic corrosion on wires and connectors.

It is a still further object of the present invention to provide an efficient anti-fouling system which uses minimal power and low current consumption.

These, as well as other objects of the present invention, are achieved by providing a system and method for preventing biofouling of boats and other water structures based on the production of sonic and ultra sonic vibrations. The system comprises an electronic control box that drives multiple membrane transducers to vibrate the hull of a boat or underwater structure. The control box has four channels or ports to which several transducers per channel can be connected and is powered by a twelve volt battery. The number of transducers needed depends on the size of the structure to be protected.

The system transfers trains of pulses of energy to the structure to which it is attached. The duration of the pulses, the time between pulses and the time between pulse trains is programmed in the microprocessor of the control unit. These parameters can be changed by reprogramming the microprocessor accordingly. One version of this control unit allows communication with an external computer to reprogram the pulse parameters.

The main components of the transducer include a housing, a resilient diaphragm of magnetic material mounted on the housing so as to have a supported portion and an unsupported portion, an electromagnet mounted in the housing so as to be spaced apart from the unsupported portion of the resilient diaphragm, and a membrane of elastic material mounted in the housing for compensation of volume changes in the air gap between the electromagnet and the magnetic diaphragm. In operation, the electromagnet is energized to apply an attractive force to and deform the unsupported portion of the resilient diaphragm.

The force produced on the diaphragm by the electromagnet increases when the distance from the electromagnet to the diaphragm decreases. The gap that separates the electromagnet from the diaphragm is very small, around for example, 150 μm, and hence the generated force is large. To avoid collapse of the diaphragm when the transducer is under a high external pressure, such as when is under several feet of water, an elastic membrane is mounted on the housing. This elastic membrane deflects easily and adjusts for the changes in the air volume inside the unit due to the variations in pressure or temperature to which the system is subjected. The air volume inside the resonator is minimized by filling most of the volume with a rigid material, for example, epoxy glue. The compensating membrane can deflect in such a way that it compensates for variations in the internal air volume of up to twenty percent. The coating used to protect the resonator from corrosion induced by contact with external air is of a thickness that allows large deflections without cracking. The coating is a very fast curing two part polyurethane that is sprayed on the resonator in two steps. During the first step, a thick coating is applied to the elastic membrane to seal the assembly screws and the gap between the membrane and the zinc alloy die cast resonator body. The second step requires the application of a thin layer on the body to cover the elastic membrane and the body.

According to another aspect of the invention, a controller provides current to the electromagnet to activate the force on the diaphragm. The electromagnet comprises a soft magnetic material core that is easily saturated when excited by the controller. This allows the connection of several transducers into one port of the controller without changes in the vibration level of each transducer. The driver for each port of the controller still has current limiting electronics to protect the controller and the battery from damage produced by a short circuit.

The controller includes a microprocessor and produces a train of short pulses of electrical current that in turn induce the vibration on the resonator diaphragm. Current is only drawn from the battery during the pulse cycles, so very little average power is used. The controller of this invention works in a pull-up configuration, such that the transducer wires, the connecting wires, and the controller terminals are most of the time at zero voltage, minimizing electrolytic corrosion. Systems in the market have wires and terminals directly connected to the battery, and hence are very susceptible to electrolytic corrosion.

DESCRIPTION OF THE PREFERRED EMBODIMENTS

Figure 1:
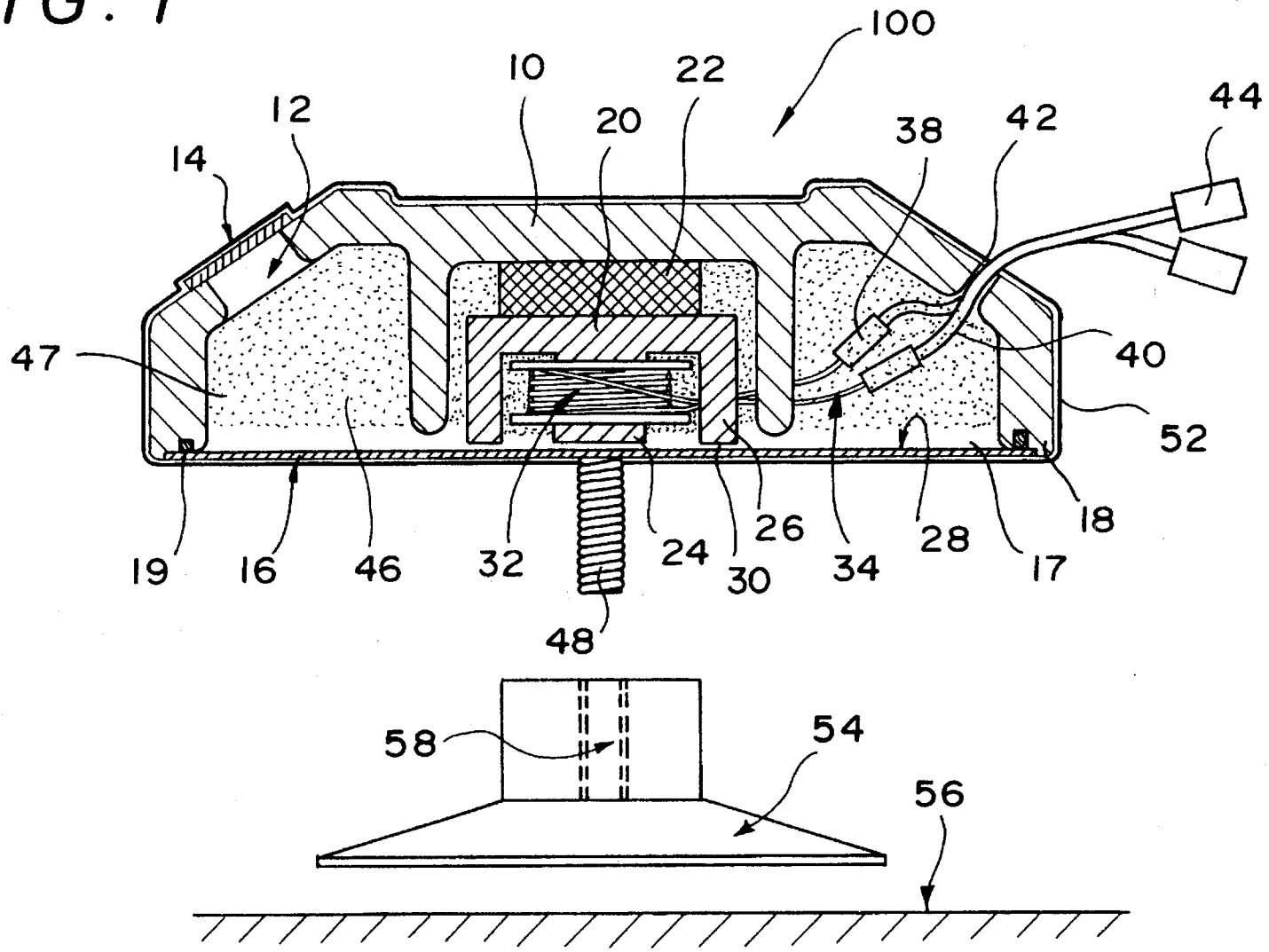
FIG. 1 is a cross-sectional view of a transducer made in accordance with a preferred embodiment of the present invention.

FIG. 1 provides a general view of the novel transducer or resonator used in the anti-fouling system of the present invention. The transducer 100 includes a housing 10 made of zinc alloy material. This housing includes an aperture 12 which is covered by a membrane 14 made of elastic material attached to the housing structure. A resilient diaphragm 16 of magnetic material, such as steel, is peripherally supported over an opening 17 in the housing by an annular edge 18 at the bottom of the housing. This diaphragm is sealed by a resilient seal 19.

An electromagnet 20 is supported in housing 10 on support post 22. The electromagnet is configured as a unitary double cylinder having an inner pole piece comprising cylindrical bobbin 24 and an outer pole piece comprising cylindrical cup 26. Both the cylindrical bobbin 24 and cup 26 of the electromagnet are made of a magnetizable material, such as a ferrite material.

The electromagnet is positioned behind the rear face 28 of the diaphragm 16 at the unsupported portion of the diaphragm such that them is a small gap 30 between the electromagnet and the rear face 28 of the diaphragm. The bobbin 24 is wound with a coil 32 of wire 34. The ends of wire 34 are joined to connectors 38, and cables 40 extending from the connectors pass through an opening 42 in the side of the housing 10 to the exterior of the housing. The cables terminate in connectors 44. The top portion of the housing is filled with a solid material 46, such as epoxy which closes the opening 42 and increases the material mass of the transducer. This epoxy encapsulates most of the electromagnet 20, but is spaced above the diaphragm 16 to permit vibration of the diaphragm and to expose the pole faces of the cylindrical bobbin 24 and the cap 26. A channel 47 through the epoxy connects the opening 12 to the space 49 between the epoxy and the diaphragm 16.

The transducer is covered with a waterproof coating 52, such as polyurethane, of a thickness that allows large deflections without cracking. The coating is a very fast curing two part polyurethane that is sprayed on the resonator in two steps. During the first step, a thicker coating is applied to portions of the membrane 14 to seal the assembly screws and the gap between the membrane and the zinc alloy die cast resonator housing. The second step requires the application of a thin layer of coating on the housing to cover the membrane 14, the diaphragm 16 and the housing 10.

A mount 54 is adapted to be affixed to a structure 56, such as by welding. The mount supports a threaded chamber 58 which is sized to receive a threaded mounting shaft 48 extending from the outside face of the diaphragm 16. In use, the mount 54 is attached to the structure 56, which is intended to be used underwater, and the mounting shaft 48 is screwed into the mount 54. Connectors 44 are connected to a controller for providing pulses of current to the electromagnet 20. When current is circulated through the coil 32 of the electromagnet, the diaphragm 16 acts as a short for the magnetic circuit formed by the electromagnet and diaphragm.

When a changing current is circulated through the coil 32 in either direction, an attractive force is created between the unsupported portion of the diaphragm and the electromagnet. This force deforms the diaphragm; however, since the position of the unsupported portion of the diaphragm adjacent the electromagnet is fixed by the mounting shaft 48, the deformation of the diaphragm moves the rest of the transducer assembly toward structure 56. When current through the coil is turned off, the diaphragm moves back toward its undeformed position moving the rest of the transducer away from structure 56. The acceleration of the transducer toward and away from structure 56 produces intermittent forces which are transmitted to the structure through mounting shaft 48 and mount 54. These intermittent forces result from the vibrational motion of the transducer which is passed to the structure 56.

Figure 2:
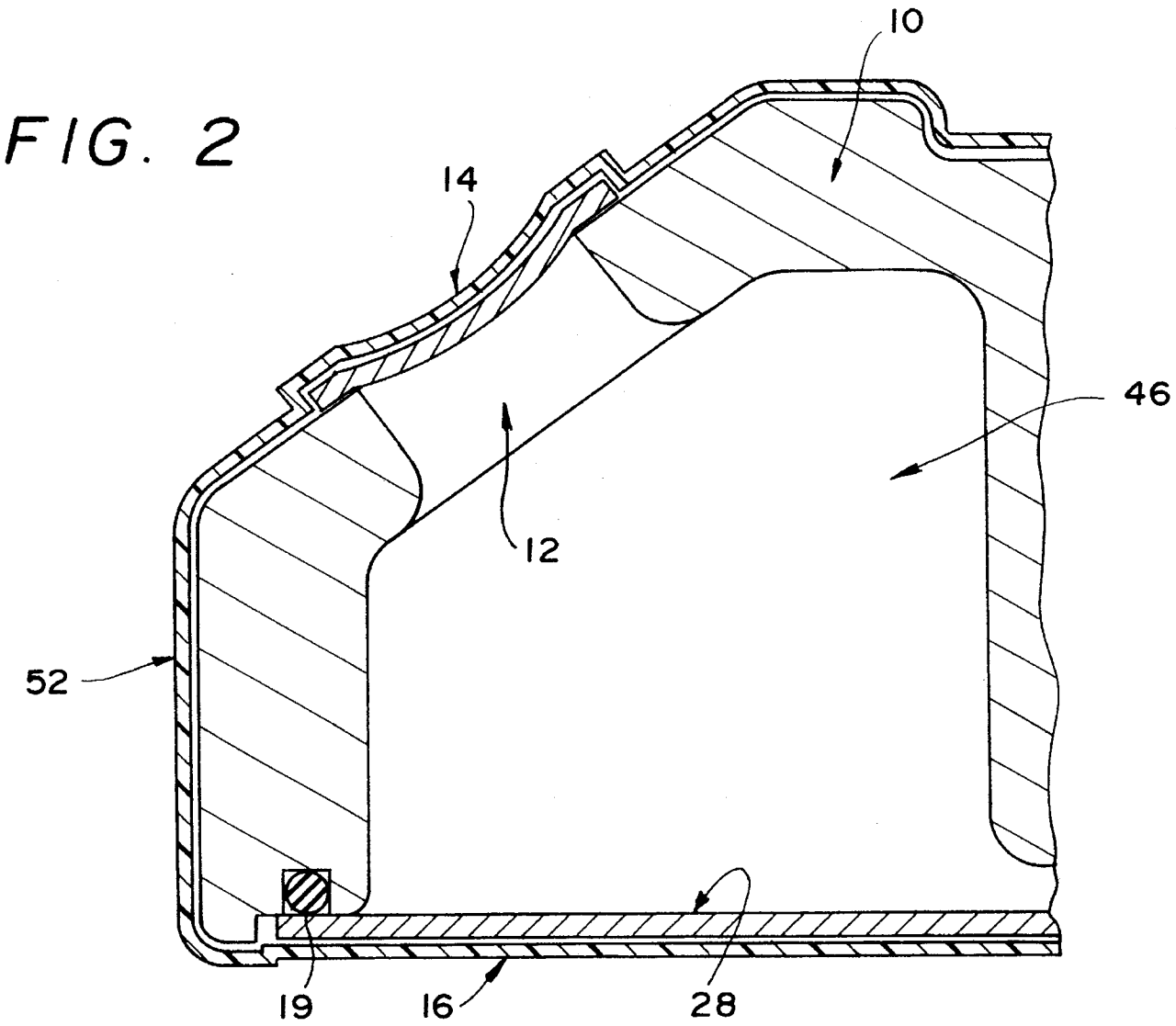
FIG. 2 is a cross sectional view of a section of the transducer of FIG. 1 showing deflection of the elastic membrane as integrated with the upper section of the transducer.

A detail of the region around membrane 14 is shown in FIG. 2. Membrane 14 is made of an elastic material, for example a self-adhesive film of silicone rubber and can deflect enough to produce variations in the air in the spaces left inside the transducer 100 of up to twenty percent, as shown in FIG. 2. If the transducer 100 is installed under a large volume of water, the pressure surrounding the transducer increases causing the volume of air inside the transducer 100 to decrease. For a depth of one meter of water, the increase in pressure and decrease in air volume is approximately ten percent. Also, a decrease in temperature from 22° C. (300° Kelvin) to 7° C. produces a decrease in air volume of five percent. If membrane 14 were not present, the reduced air volume would cause the diaphragm 16 to move towards the electromagnet 20, closing the gap 30. In effect, the system would stop working. Consequently, the transducer would not produce an external magnetic field which could result in undesired electromagnetic interference.

Maximum energy may be transmitted to the structure 56 by optimizing the magnetic gap 30, the diameter of coil 32, number of turns of the coil, ferrite size and material, mass of the transducer assembly, and thickness and diameter of the diaphragm 16.

Another consideration in the design of the transducer is that it is desirable to minimize the current consumption of the transducer, since the current for the transducer is normally drawn from a battery. One way to reduce current consumption is to maximize the rate of change of current in the transducer when a current pulse is applied. As a result, the time duration of the current pulse is minimized which will produce a desired current in the transducer of a desired duration. Since the rate of change in current varies inversely with the inductance of the transducer, the rate of change of the current is maximized by minimizing the inductance. Inductance may be reduced by reducing the number of turns of coil 32 around bobbin 24 and by reducing eddy currents in the core, which comprises bobbin 24 and cup 26, and in the diaphragm 16. Furthermore, constructing the core from ferrite substantially eliminates the induced currents in the core. Induced currents in diaphragm 16 are reduced by making a thin diaphragm and judiciously choosing its composition. A one millimeter thick diaphragm of steel has been found to work well.

An additional approach for providing efficient energy transfer is to minimize the resistance of coil 32 to maximize the electrical energy transferred to diaphragm 16. A lower limit for this resistance must be set to prevent current variations due to the different resistances of cables of different lengths from the controller to the resonator. As an example, it has been calculated and experimentally found that the transducer works satisfactorily with forty-eight turns of wire 34 around the bobbin 24 of an effective area of 0.95 $cm_2$. A possible choice for the wire 34 is a magnet wire of diameter 5 mils (0.1270 mm) with a resistance of 0.361 ohms per km (at 20° C.). This combination gives a coil ohmic resistance of around 3 ohms. A transducer 100 made in accordance with this invention and attached to a structure 56, when excited with a current of 2 Amps, may produce a sound weak enough and of a pitch that does not bother humans in the vicinity but produces vibrations of an amplitude and frequency composition adequate to be an irritant to barnacles and other aquatic organisms causing them to avoid at least a three meter diameter area of the structure 56 around the transducer 100.

Figure 3:
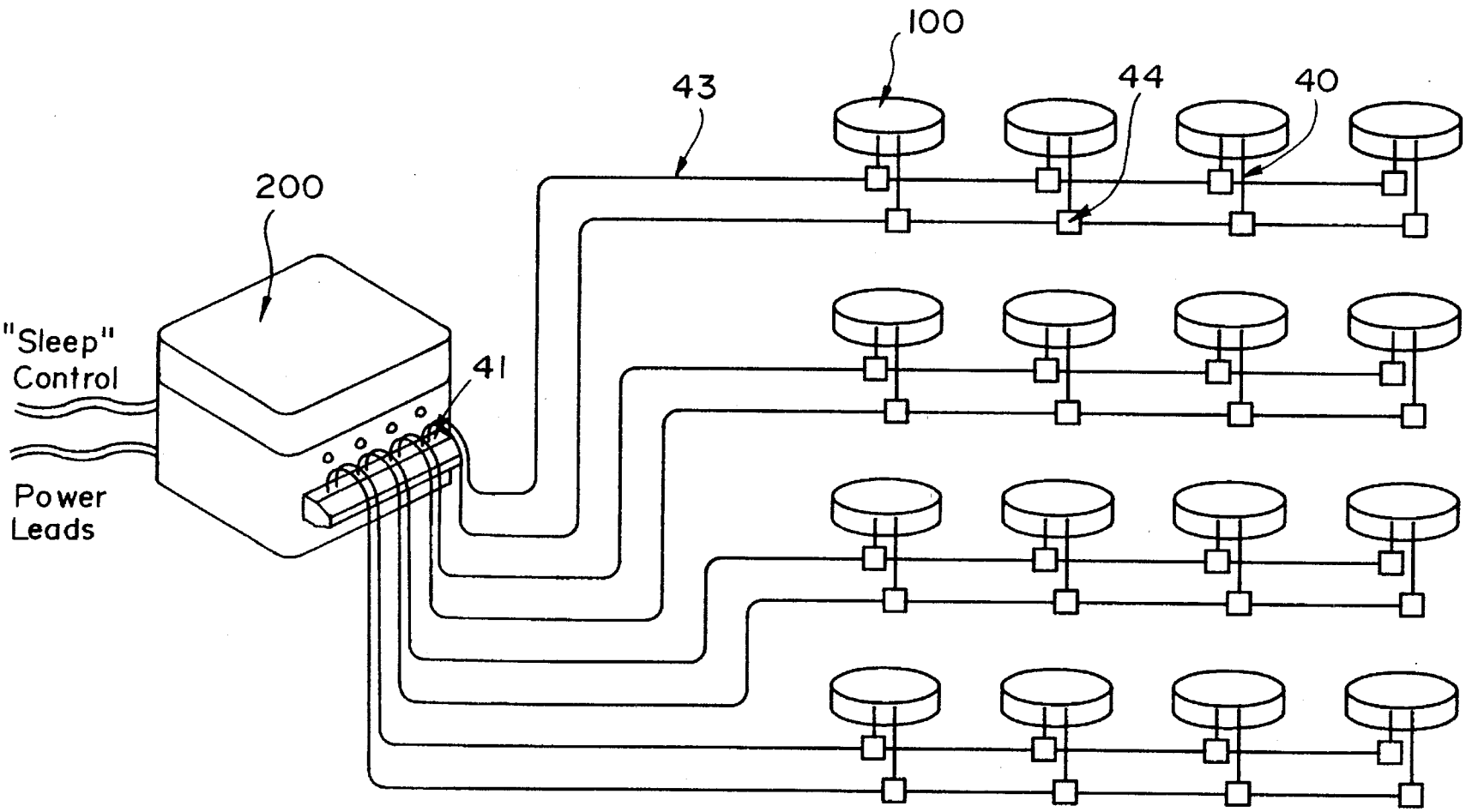
FIG. 3 shows a general circuit diagram of the system with multiple transducers connected with a single control unit.

FIG. 3 shows a diagram of the anti-fouling system of the present invention with a control unit 200 having four output ports 41 and four transducers 100 connected to each port by cable 43. The control unit 200 draws power from a power source, such as a battery, and produces the electrical current pulses that are sent from the output ports to the transducers 100. It is the object of this invention that several transducers be connected at each port without a change in sound level between the first transducer connected to the control unit 200 and the last. Furthermore, the sound level of the transducers should not vary when connected to different output ports. The number of transducers to be installed depends on the size of the structure to be protected. It has been found that for the transducers of this invention, the distance between them should not be larger than three meters, otherwise certain areas of the structure 56 would be left unprotected. If the structure has divisions such as bulkheads, one transducer should be mounted at each side of the bulkhead.

The control unit 200 includes a microprocessor which generates trains of ten pulses of electric current, each pulse of a duration of 400 microseconds. The trains are produced alternatively in each output port. The trains of pulses are separated by rest times, in such a way that the total cycle period is 3.65 seconds. The microprocessor is drawing current from the battery only during the pulses, which calculates to be 0.44% of the actual cycle time. The control unit 200 remains in a "sleep" mode for the rest of the cycle time. The battery supplies 12 Volts and the controller has, as an example, an electrical resistance such that a maximum current of 8.5 Amps can be supplied to each output port 41. For this case, the actual average current consumption is only 36 ma so that a standard 90 Amps/hour battery would last for more than 3 months of operation without recharging. Moreover, a user may activate a prolonged "sleep" mode with a control switch.

The transducers transfer a vibration to underwater structure 56 adequate to avoid the attachment of biofouling organisms. It is important that the vibration amplitude transferred by each transducer does not decrease when several transducers are connected to the same controller output port 41. Since the transducer of this invention utilizes an electromagnet, the magnetic field inside the pole pieces of the electromagnet is current induced. Accordingly, the maximum magnetic field is the saturation flux density of the magnetic material from which the pole pieces are constructed. Below saturation, the magnetic field and hence, the magnetic force produced, increases when the current circulating in the coil increases, with the actual strength determined by the coil design parameters, the core material type, and the magnetic circuit gap.

Once the resonator core has been saturated by the magnetic field induced by the excitation current, the effective gap between the electromagnet and the resilient diaphragm increases from 150 microns, in this example, to several centimeters. Further increases in the current produce a negligible increase in the magnetic force. This means that the force is limited by the saturation of the ferrite core, rather than by the ohmic resistance of the resonator or by the current compliance of the controller.

Figure 4:
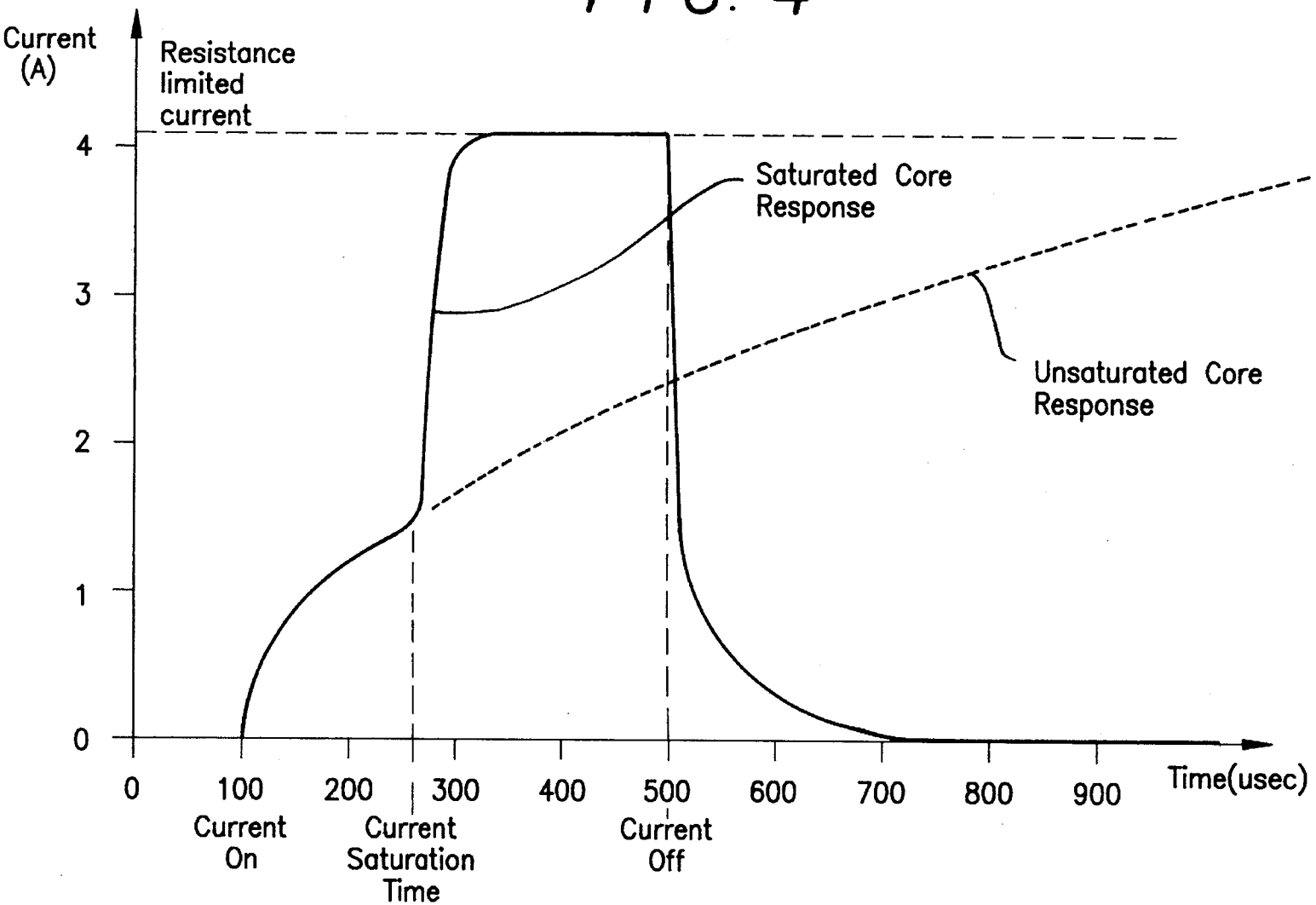
FIG. 4 is a graph of the transducer response as a function of time.

FIG. 4 is a conceptual graph showing the behavior of the actual current in the transducer during one of the pulses generated by control unit 200. The figure corresponds to the case of a single transducer in an output port. When the signal from the microprocessor is received, the current starts increasing from zero until it reaches its saturation value, in this case 1.7 Amps. At this point, the core reaches saturation, and there is a steep jump in the current until either the controller current compliance is reached or the current becomes limited by the resonator-resistance. After saturation it does not change until the microprocessor disconnects it from the source after 400 microseconds from the starting of the pulse. The jump would be up to the resistance limited current as illustrated in FIG. 4. The current increase between 1.7 Amps and 4 Amps does not translate into an increased force; on the contrary, the electromagnetic force remains essentially at the stone level once the current increases beyond 1.7 Amps.

The effect of this design is that several resonators can be connected to the same port without affecting the sonic energy of each one up to a number equal to the current compliance of the controller divided by the saturation current that produces saturation of the resonator ferrite core. As an example, for a current compliance of 8.5 Amps and a core saturation current of 1.7 Amps, up to five resonators can be connected to each port without affecting the sonic output of each resonator. Under this condition, one resonator alone would have its current determined by its resistance which would be 4 Amps in this case. For any number above up to five, the limiting current for each one would be larger than the saturation current. Since any value on or above saturation would produce the same effect, with only second order variations, small differences in the values of the electronic components of the controller circuit are not going to produce the undesired changes in sound level from port to port. Large structures may require many resonators to be driven by a single controller. A simple adjustment of the current supplied by the controller allows an increase in the maximum number of resonators which can be connected to a single port. To compensate for additional resonators attached to an output port, the user would divide the compliance controller current by the resonator saturation current. For saturation current of 1.7 A, a controller supplying 17 Amps would allow up to 10 resonators to be connected per port.

It should be noticed that the peak current values of several Amps are quite high. The fact that current is drawn only a small percentage of the time, makes it possible to work under saturation conditions and still have a low power consumption.

Figure 5:
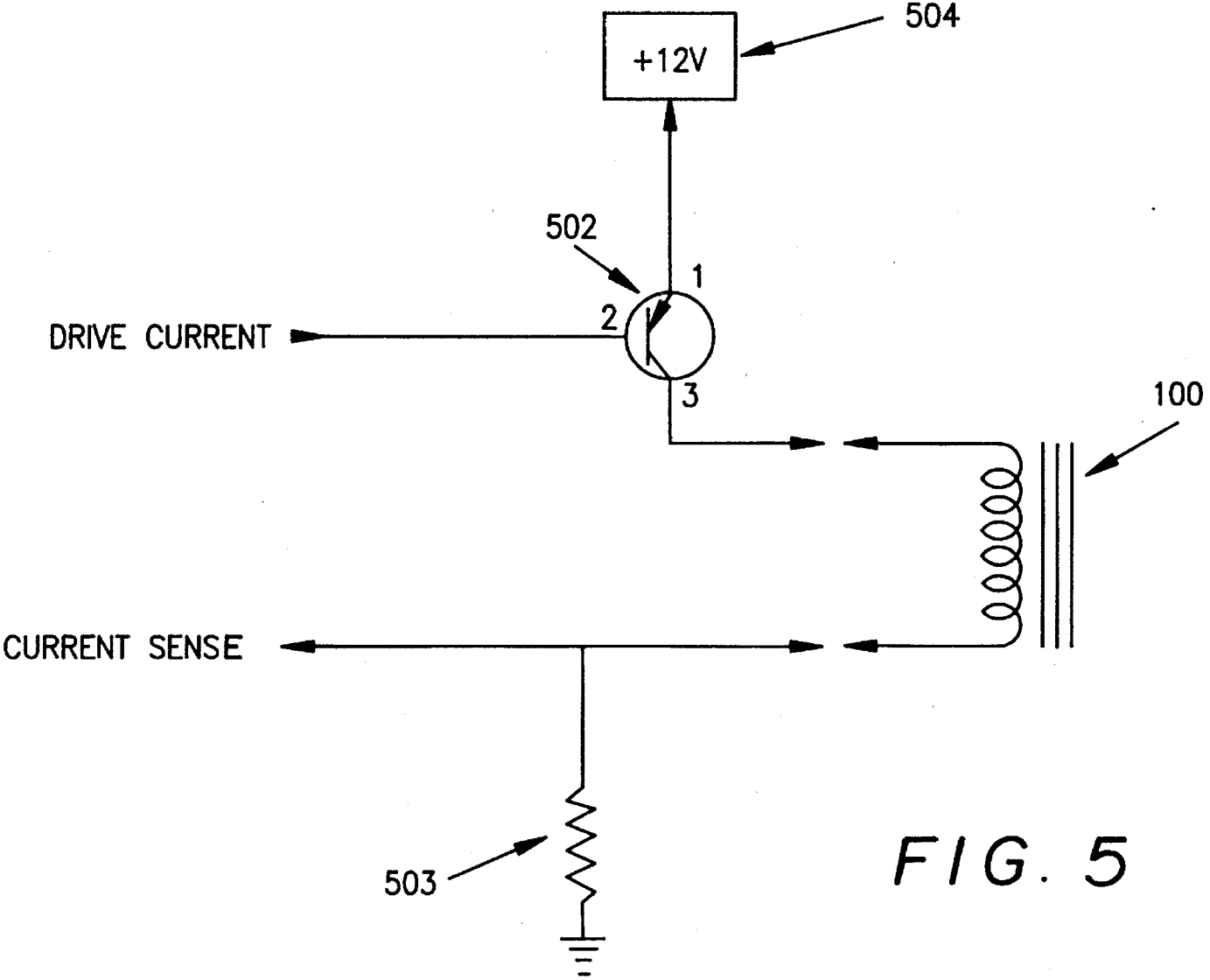
FIGS. 5 shows the switching drive circuit for minimizing corrosion in accordance with a preferred embodiment of the present invention.

The control system of this invention has a circuit of the pull up or high side type as described in FIG. 5. The pull up transducer drive circuit comprises the system power supply battery 504, a transistor 502, at least one resonator 100 and a resistor 503. Current is drawn to the resonator 100 through the transistor 502. One side of the resonator 100 is continuously connected to ground. The other side is connected to the drive transistor 502. Due to the type of pulse cycle produced by the microprocessor, the drive transistor is not conducting most of the time. When the microprocessor sends a pulse, the control drive circuit causes the drive transistor to conduct and the resonator is activated. During the pulse, the transistor provides a connection between the resonator and the positive voltage of the battery.

As a result of this configuration, the resonator is always connected to ground except during the pulse cycles. Thus, the resonator and the wires from the controller will be continuously at zero voltage, except for the short pulse time during which a positive voltage is applied. Also, since no voltage difference exists between the resonator and the controller when the processor is in a "sleep" mode, electrolytic corrosion of the system is minimized.

Figure 6:
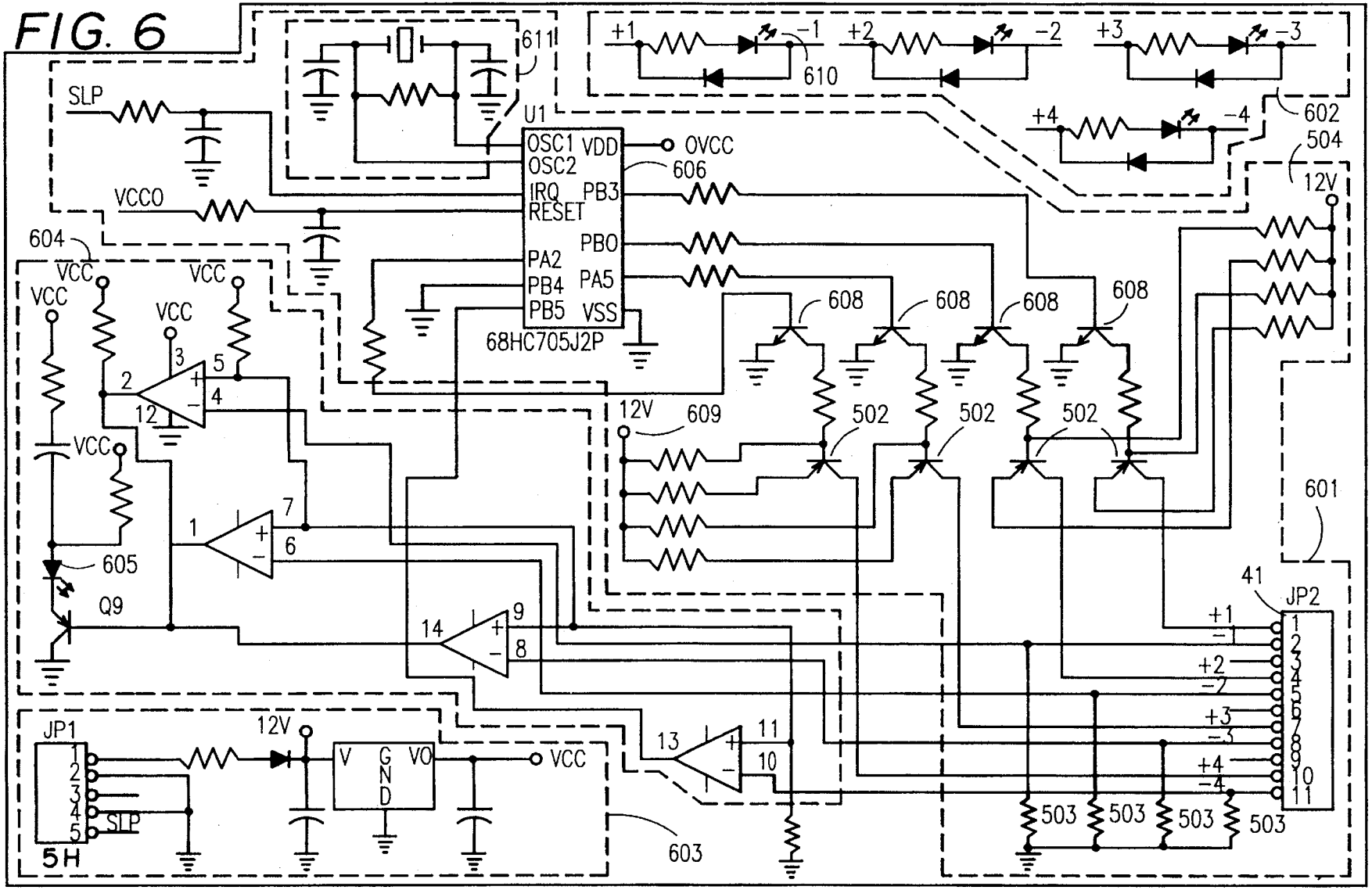
FIG. 6 is a schematic diagram of the control circuit in accordance with the present invention.

FIG. 6 shows, as an example, a complete schematic of the control circuit configuration for the controller used in this invention. Block 601 shows the four output ports 41 with two drive transistors 608 and 502 for each port, the 12 Volt battery source 504 and a processor 606. Block 602 shows a light emitting diode circuit 610 for each output port of the controller while block 603 illustrates the power circuit for the controller. Block 604 illustrates a circuit connected to the output ports 41 for providing a signal to a user via a light emitting diode 605 indicating when a positive voltage difference is sensed on the low side of the drive circuit. Block 611 is an oscillator circuit that provides timing pulses to the processor 606. In operation, the processor 606 provides a series of simple functions such as controlling the amplitude of the pulses received from the oscillator circuit 611, timing the pulses sent to each output port and sequencing the pulses to control the pulses sent to each output port during a cycle period. The processor 606 receives a train of pulses from the oscillator circuit 611, sets the amplitude and frequency of the pulses, and sends the pulses sequentially to the output ports. The train of pulses from the processor 606 activates a transistor 608, which turns on a transistor 502 for a pulse cycle which, in the preferred embodiment, is 400 microseconds. Once a transistor 502 is turned on, the current pulses are sent to an output port 41, with one port being activated while the other ports remain in a"sleep mode". Thus, in a total cycle period of 3.65 seconds, for example, a train of pulses are sent to one port while the other ports remain dormant. Then, a train of pulses are sent to a second port while the other ports remain dormant. These pulse cycles are repeated until all ports have received a train of current pulses from the controller. Upon reaching the output ports, the pulses are sent to one or more transducers to provide vibrational forces to structure 56, shown in FIG. 1.

While the invention has been described with reference to the aforementioned embodiment, it should be appreciated by those skilled in the art that the invention may be practiced otherwise than as specifically described herein without departing from the spirit and scope of the invention. It is therefore, understood that the scope of the invention is limited only by the appended claims.

What is claimed is:

1. A vibrational system for use in inhibiting the attachment of aquatic life forms to underwater structures comprising:

a plurality of transducers including at least a first and a second transducer adapted-to be mounted upon said underwater structure to impart vibrations thereto, each such transducer including:

a housing defining a central chamber, said housing having a first opening extending through said housing into said central chamber;

a resilient diaphragm of magnetic material mounted on said housing and extending across said first opening, said resilient diaphragm having a front face and a rear face;

an electromagnet mounted in said housing in spaced relation to the rear face of said diaphragm to create a small gap and responsive to a current pulse to attract and deform said diaphragm into said gap, said electromagnet being closely spaced from the rear face of said resilient diaphragm in an area within the confines of said first opening, and a transducer mount for attaching said transducer to said underwater structure, said transducer mount being secured to the front face of said resilient diaphragm; and a control circuit means connected to said plurality of transducers to sequentially impart trains of spaced current pulses to said electromagnets during a power cycle, said control circuit means including at least a first output connected to said first transducer and a second output connected to said second transducer, the control circuit means operating during a power cycle to first provide a train of current pulses to said first output and to subsequently provide a train of current pulses to said second output after terminating the provision of power pulses to said first output.

2. The system of claim 1 wherein a first plurality of transducers are connected to said first output to simultaneously receive a train of current pulses therefrom during a power cycle and a second plurality of transducers are connected to said second output to simultaneously receive a train of current pulses therefrom during a power cycle, the electromagnets of each of said transducers including a soft magnetic core unit which saturates in response to a current pulse having an amplitude above a saturating amplitude, said control means operating to provide current pulses to said first and second outputs of sufficient amplitude to saturate the core units of the electromagnets of said first and second plurality of transducers.

3. The system of claim 2 wherein said control circuit means includes a circuit ground having substantially a zero ground potential, first transducer drive means connected to said first output and a second transducer drive means connected to said second output, said first transducer drive means operating to maintain said first plurality of transducers at said ground potential except during receipt thereby of a current pulse train and said second transducer drive means operating to maintain said second plurality of transducers at said ground potential except during receipt thereby of a current pulse train.

4. The system of claim 3 wherein said first and second transducer drive means are connected to a battery power supply and operate in response to the receipt of control pulses to supply current pulses to said first and second outputs respectively, said control circuit means including processor means operative to selectively supply control pulses to said first and second transducer drive means during a power cycle, said processor means operating to provide control pulses which control the frequency and time duration of said current pulse trains.

5. The system of claim 4 wherein the soft magnetic core unit of each of said transducers is a ferrite core, and wherein the diaphragm of each of said transducers in a one millimeter thick diaphragm of steel.

6. The system of claim 5 wherein the housing of each of said transducers includes a bottom wall which includes said first opening and a top wall spaced from said bottom wall, said top wall including a second opening and an elastic membrane mounted on said top wall to cover said second opening, said elastic membrane being deformable relative to said second opening, and an encapsulating material partially filling said housing and partially encapsulating said electromagnet, said encapsulating material extending from said top wall and being spaced from said bottom wall for a distance at least equal to the gap between said electromagnet and said diaphragm, and an opening in said encapsulating material extending between said second opening and the space between said encapsulating material and said bottom wall, said elastic membrane being deformable in response to pressure to control the air volume in said space to maintain the air volume substantially constant.

7. The system of claim 6 wherein said processor means supplies control pulses to said first and second transducer drive means to cause said first and second transducer drive means to provide current pulse trains of current pulses, each current pulse of which has a duration of 400 microseconds.

8. A vibrational system for use in inhibiting the attachment of aquatic life forms to underwater structures comprising:

a housing defining a central chamber having a bottom wall and a top wall, a first opening formed in said bottom wall and a second opening formed in said top wall, a resilient diaphragm of magnetic material mounted on said bottom wall and extending across said first opening, said resilient diaphragm having a rear face directed toward said central chamber and a front face directed away from said central chamber, an electromagnet mounted in said central chamber in spaced relation to the rear face of said diaphragm to create a small gap therebetween in an area within the confines of said first opening, said electromagnet operating in response to a current pulse to attract and deform said diaphragm into said gap, an elastic membrane mounted on said top wall to cover said second opening, said elastic membrane being deformable relative to said second opening, and a solid encapsulating material partially filling said central chamber and partially encapsulating said electromagnetic, said encapsulating material extending from said top wall and filling said chamber except for a space between said encapsulating material and said bottom wall having a width at least equal to the gap between said electromagnet and said diaphragm, and a channel formed in said encapsulating material connecting said space to said second opening, said elastic membrane being deformable in response to pressure to control the air volume in said space to maintain the air volume substantially constant.

9. The system of claim 8 which includes a mount for attaching said housing to an underwater structure, said mount being secured to the front face of said resilient diaphragm substantially centrally of said first opening, said second opening being smaller than said first opening.

10. The system of claim 9 wherein said electromagnet includes a magnetic core unit having poles facing said gap, said core unit saturating in response to receipt by said electromagnet of a current pulse above a saturating amplitude.

11. The system of claim 10 wherein said housing, said elastic membrane and the front face of said diaphragm are coated with a layer of elastic waterproof coating.

12. The system of claim 11, wherein said core unit comprises a double cylinder having a central inner cylinder to form an inner pole piece and a surround cup-like couter cylinder to form an outer pole piece.

13. The system of claim 12, wherein said inner pole piece is wound with an energizable coil.

14. The system of claim 11 wherein said elastic waterproof coating is composed of polyurethane.

* * * * *